US009128416B2

(12) United States Patent
Kadota et al.

(10) Patent No.: US 9,128,416 B2
(45) Date of Patent: Sep. 8, 2015

(54) DEVELOPING DEVICE, PROCESS CARTRIDGE, IMAGE FORMING APPARATUS, AND DEVELOPER TRANSFER METHOD

(71) Applicants: Ichiro Kadota, Kanagawa (JP); Yuuji Ishikura, Kanagawa (JP)

(72) Inventors: Ichiro Kadota, Kanagawa (JP); Yuuji Ishikura, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/542,870

(22) Filed: Nov. 17, 2014

(65) Prior Publication Data

US 2015/0147094 A1 May 28, 2015

(30) Foreign Application Priority Data

Nov. 26, 2013 (JP) ..... 2013-244159

(51) Int. Cl.
*G03G 15/08* (2006.01)

(52) U.S. Cl.
CPC ..... *G03G 15/0891* (2013.01); *G03G 15/0822* (2013.01)

(58) Field of Classification Search
CPC ..... G03G 15/0822; G03G 15/0891
USPC ..... 399/254–256
See application file for complete search history.

(56) References Cited

U.S. PATENT DOCUMENTS

| | | | | |
|---|---|---|---|---|
| 7,848,682 | B2 * | 12/2010 | Tanaka | 399/254 |
| 2004/0096244 | A1 | 5/2004 | Kadota et al. | |
| 2006/0013604 | A1 | 1/2006 | Kadota et al. | |
| 2007/0098449 | A1 | 5/2007 | Kadota et al. | |
| 2007/0160395 | A1 | 7/2007 | Kosugi et al. | |
| 2008/0286015 | A1 | 11/2008 | Kadota et al. | |
| 2009/0022523 | A1 | 1/2009 | Kadota et al. | |
| 2010/0021214 | A1 | 1/2010 | Kadota et al. | |
| 2011/0176820 | A1 | 7/2011 | Kadota et al. | |
| 2013/0243499 | A1 | 9/2013 | Ishikura et al. | |
| 2014/0212180 | A1 | 7/2014 | Kadota et al. | |

FOREIGN PATENT DOCUMENTS

| | | |
|---|---|---|
| JP | 2007-148053 | 6/2007 |
| JP | 2010-204343 | 9/2010 |

* cited by examiner

*Primary Examiner* — Hoang Ngo
(74) *Attorney, Agent, or Firm* — Harness, Dickey & Pierce, P.L.C.

(57) ABSTRACT

A developing device includes a developer bearer, a first developer compartment to supply developer to the developer bearer, a second developer compartment to supply developer to the first developer compartment and positioned adjacent to the first developer compartment, a partition to divide, at least partly, the first developer compartment from the second developer compartment, a communicating opening in the opening, through which developer is transferred from the second developer compartment to the first developer compartment, a rotary conveyor to transport developer inside the second developer compartment to the communicating opening and a flexible sheet provided to the rotary conveyor and positioned facing the communicating opening. The flexible sheet rotates integrally with the rotary conveyor and projects through the communicating opening into the first developer compartment as the rotary conveyor rotates.

15 Claims, 6 Drawing Sheets

DEVELOPING DEVICE, PROCESS CARTRIDGE, IMAGE FORMING APPARATUS, AND DEVELOPER TRANSFER METHOD

CROSS-REFERENCE TO RELATED APPLICATIONS

This patent application is based on and claims priority pursuant to 35 U.S.C. §119(a) to Japanese Patent Application No. 2013-244159, filed on Nov. 26, 2013, in the Japan Patent Office, the entire disclosure of which is hereby incorporated by reference herein.

BACKGROUND

1. Technical Field

Embodiments of the present invention generally relate to a developing device, a process cartridge, and an image forming apparatus, such as, a copier, a printer, a facsimile machine, a plotter, or a multifunction peripheral (MFP) having at least two of copying, printing, facsimile transmission, plotting, and scanning capabilities, and further relate to a developer transfer method.

2. Description of the Related Art

In electrophotographic image forming apparatuses, such as copiers, printers, facsimile machines, or multifunction machines, low-temperature image fixing is promoted to reduce impact on environment. Accordingly, there is an increasing possibility that developer (i.e., toner) flocculates inside a toner bottle, a toner supply device, or a developing device when the temperature therein rises during image forming operation or toner is left under hot and humid conditions.

When scooped onto a developing sleeve and used in image development, flocculation (i.e., loose aggregates) of developer results in image failure such as spots, shooting star marks, white lines, or the like in images.

SUMMARY

An embodiment of the present invention provides a developing device that includes a developer bearer, a first developer compartment to supply developer to the developer bearer, a second developer compartment to supply developer to the first developer compartment, a partition to divide, at least partly, the first developer compartment from the second developer compartment, a rotary conveyor to transport developer inside the second developer compartment to a communicating opening in the partition, through which developer is transferred from the second developer compartment to the first developer compartment, and a flexible sheet provided to the rotary conveyor and positioned facing the communicating opening. The flexible sheet rotates integrally with the rotary conveyor and projects through the communicating opening into the first developer compartment as the rotary conveyor rotates.

In another embodiment, a process cartridge includes the developing device described above and an image bearer to bear a latent image.

In yet another embodiment, an image forming apparatus includes either the developing device or the process cartridge described above.

Yet another embodiment provides a method of transferring developer in the above-described developing device. The method includes integrally rotating the rotary conveyor and the flexible sheet, and transferring developer from the second developer compartment to the first developer compartment while the flexible sheet cyclically projects into and withdraws from the first developer compartment as the rotary conveyor rotates.

Yet another embodiment provides a developing device that includes the above-described developer bearer, the above-described first and second developer compartments, the above-described partition, a means for transporting by rotation developer inside the second developer compartment to the communicating opening, and a means for loosening developer. While rotating, the means for loosening projects through the communicating opening into the first developer compartment.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
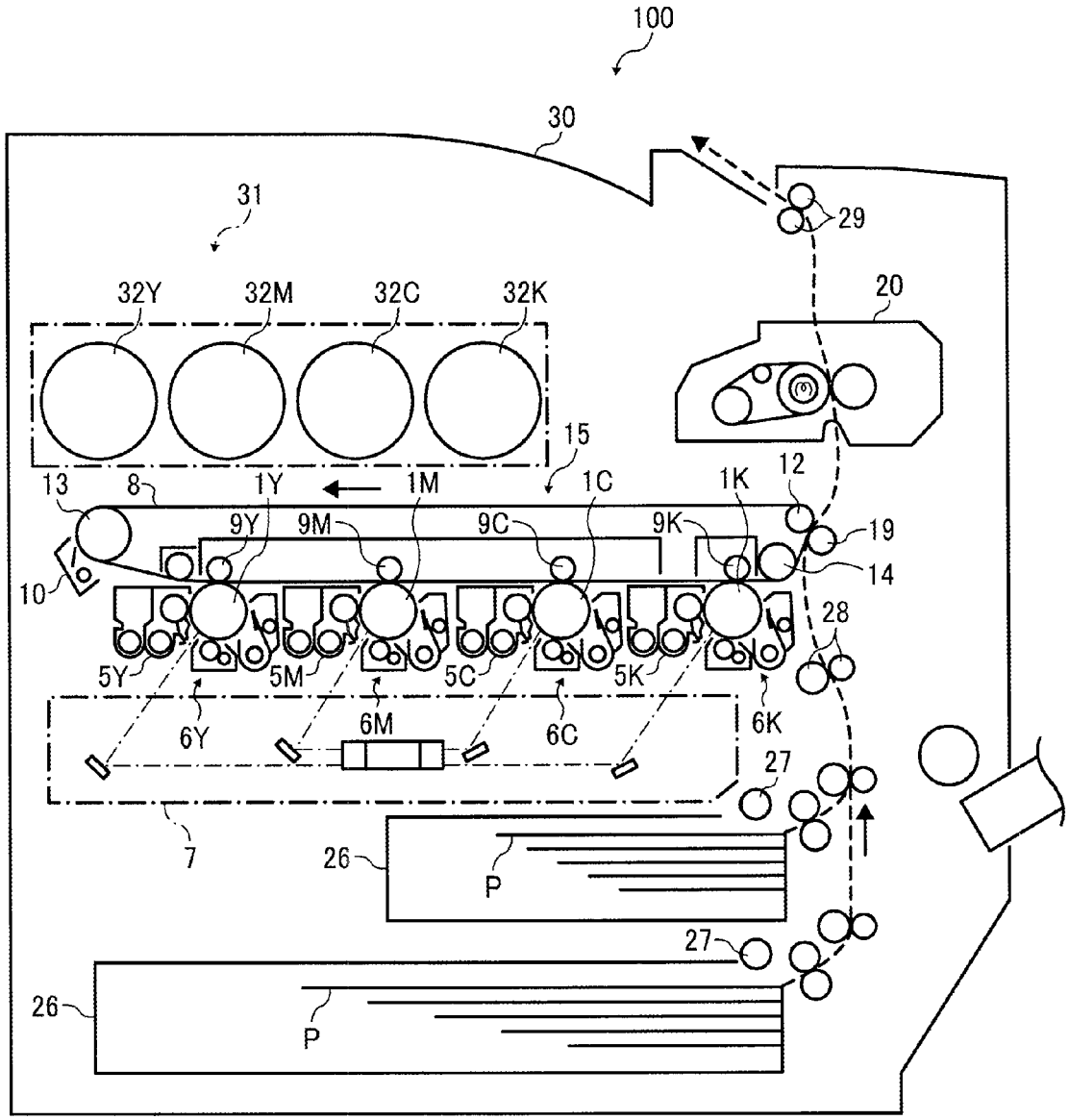
FIG. 1 is a schematic diagram of an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

The term flocculation of developer used here means that developer aggregates loosely to a degree that the aggregations can be loosened by stirring. Image failure caused by flocculation of developer in a developing device may be inhibited by using moisture-proof packaging materials or ball bearings having good slidability, increasing image output intervals, or rotating a developer bearer in reverse. These countermeasures, however, can increase the cost and usability restrictions. By contrast, when the flocculating developer can be broken inside the developing device while a standard developing process is executed, such countermeasures are not necessary.

Meanwhile, the flocculating developer may be broken upstream from a developer regulator (i.e., on the backside of the developer regulator) inside the developing device. In this case, however, the force to break the flocculation acts in the entire longitudinal range of the developer bearer, and the stress on developer may be excessive. Since the stress on developer degrades toner and carrier, it is preferred to reduce the stress on developer to inhibit degradation of toner and carrier. Thus, there is trade-off between reduction in stress and loosening flocculation.

According to the embodiment described below, flocculating developer, which are included in supplied toner or created inside a developing device, are broken upstream from a position where developer is received in a developer compartment on the side of the developer bearer (i.e., a supply-side compartment), thereby inhibiting image failure resulting from the flocculation.

Referring now to the drawings, wherein like reference numerals designate identical or corresponding parts throughout the several views thereof, and particularly to FIG. 1, a multicolor image forming apparatus according to an embodiment of the present invention is described.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

FIG. 1 is a schematic diagram of an image forming apparatus 100 according to the present embodiment.

In the configuration shown in FIG. 1, a toner supply device 31 serving as a powder supply device is provided in an upper portion of the image forming apparatus 100, which can be a printer. In the toner supply device 31, four toner cartridges 32Y, 32M, 32C, and 32K, serving as powder containers, corresponding to yellow (Y), magenta (M), cyan (C), and (K), are mounted removably and replaceably.

Other portions of the toner supply device 31 than the toner cartridges 32 function as toner conveyance devices (powder conveyance devices) to transport toner (i.e., image forming powder) to respective destinations, that is, developing devices 5 described later. An intermediate transfer unit 15 is provided beneath the toner supply device 31. Image forming units 6Y, 6M, 6C, and 6K are disposed facing an intermediate transfer belt 8 in the intermediate transfer unit 15 and arranged in that order in the direction of rotation of the intermediate transfer belt 8.

Figure 2:
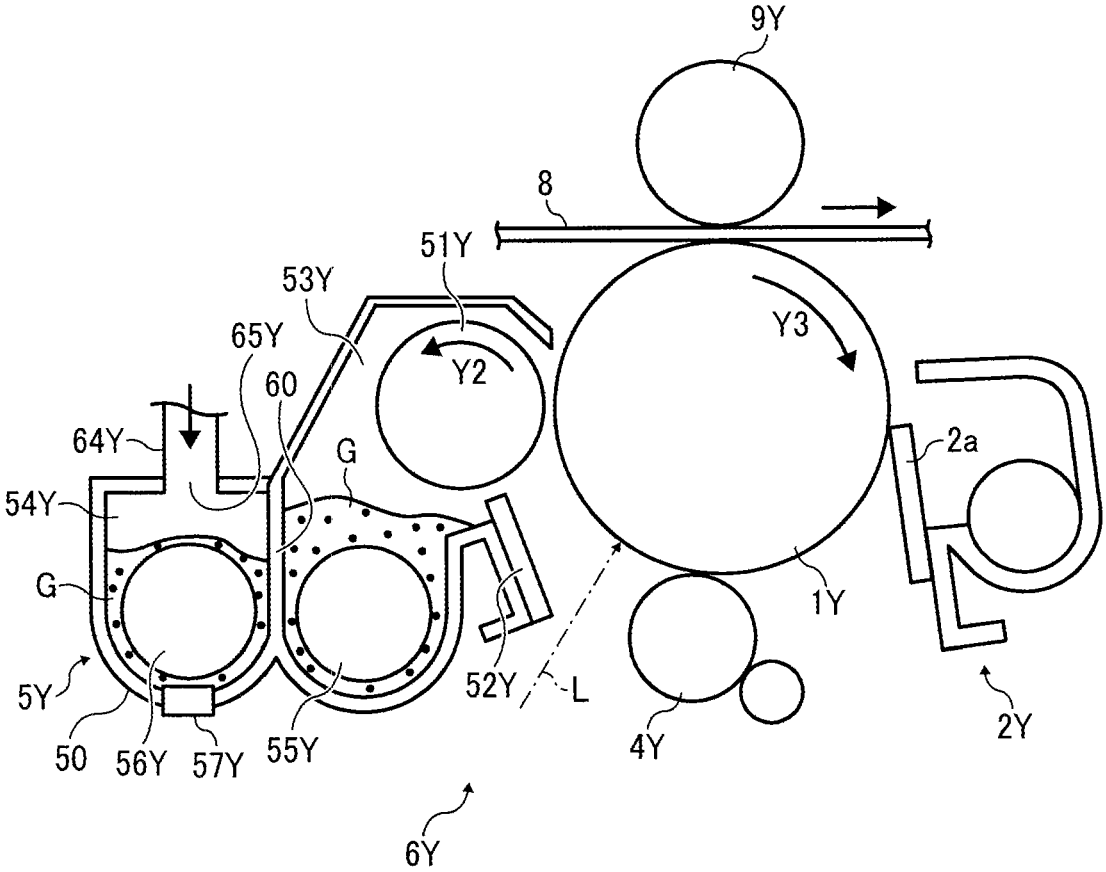
FIG. 2 is a schematic diagram illustrating a configuration of an image forming unit included in the image forming apparatus shown in FIG. 1.

FIG. 2 is an enlarged view of the image forming unit 6Y. Referring to FIG. 2, the image forming unit 6Y for yellow includes a photoconductor drum 1Y and further includes a charging member 4Y, the developing device 5Y (i.e., a developing unit), a cleaning unit 2Y, a discharger, and the like provided around the photoconductor drum 1Y. Image forming processes, namely, charging, exposure, developing, transfer, and cleaning processes are performed on the photoconductor drum 1Y, and thus a yellow toner image is formed on the photoconductor drum 1Y.

The image forming unit 6Y can be configured as a process cartridge in which the photoconductor drum 1Y, the charging member 4Y, the developing device 5Y, and the cleaning unit 2Y are united into a modular unit. Alternatively, the respective components may be independent units to be removably installed in a body of the apparatus (i.e., an apparatus body) independently. For example, the developing device 5 may be designed as an independent unit removably installed in the apparatus body. Yet alternatively, the developing device 5Y and at least one of the photoconductor drum 1Y, the charging member 4Y, and the cleaning unit 2Y may be united together as a modular unit removably installed in the apparatus body.

It is to be noted that other image forming units 6 have a similar configuration to that of the yellow image forming unit 6Y except the color of toner used therein and form toner images of the respective colors.

Thus, the image forming unit 6Y is described below as a representative and descriptions of other image forming units 6 are omitted.

Referring to FIG. 2, the photoconductor drum 1Y is rotated clockwise as indicated by arrow Y3 shown in FIG. 2 by a driving motor. The surface of the photoconductor drum 1Y is charged uniformly by the charging member 4Y at a position facing the charging member 4Y (i.e., charging process). When the surface of the photoconductor drum 1Y reaches a position irradiated with a laser beam L (exposure light) emitted from an exposure device 7 (shown in FIG. 1), an electrostatic latent image for yellow is formed thereon by scanning with the exposure light (i.e., exposure process).

The developing device 5Y develops the electrostatic latent image on the photoconductor drum 1Y into a yellow toner image (i.e., developing process). The yellow toner image is primarily transferred from the photoconductor drum 1Y onto the intermediate transfer belt 8 (i.e., primary-transfer process).

When the surface of the photoconductor drum 1Y reaches a position facing the cleaning unit 2Y, a cleaning blade 2*a* of the cleaning unit 2Y mechanically collects toner remaining on the photoconductor drum 1Y (cleaning process).

Subsequently, the discharger removes potentials remaining on the surface of the photoconductor drum 1Y.

Thus, a sequence of image forming processes performed on the photoconductor drum 1Y is completed.

The above-described image forming processes are performed in the image forming units 6M, 6C, and 6K similarly to the yellow image forming unit 6Y. That is, the exposure device 7 disposed beneath the image forming units 6 in FIG. 1 directs laser beams L according to image data onto the photoconductor drums 1 in the respective image forming units 6. Specifically, the exposure device 7 includes light sources to emit the laser beams L, multiple optical elements, and a polygon mirror that is rotated by a motor. The exposure device 7 directs the laser beams L to the respective photoconductor drums 1 via the multiple optical elements while deflecting the laser beams L with the polygon mirror.

Then, the toner images formed on the respective photoconductor drums 1 through the developing process are transferred therefrom and superimposed one on another on the intermediate transfer belt 8. Thus, a multicolor toner image is formed on the intermediate transfer belt 8.

Referring now to FIG. 1, the intermediate transfer unit 15 includes the intermediate transfer belt 8, four primary-transfer bias rollers 9, a secondary-transfer backup roller 12, a cleaning backup roller 13, a tension roller 14, an intermediate-transfer cleaning unit 10, and the like. The intermediate transfer belt 8 is supported by the above-described rollers 12, 13, and 14 and is rotated in the direction indicated by an arrow shown in FIG. 1 as the secondary-transfer backup roller 12 rotates.

The four primary-transfer bias rollers 9 are pressed against the corresponding photoconductor drums 1 via the intermediate transfer belt 8, and four contact portions between the primary-transfer bias rollers 9 and the corresponding photoconductor drums 1 are hereinafter referred to as primary-transfer nips. Each primary-transfer bias roller 9 receives a transfer bias whose polarity is opposite the charge polarity of toner. While rotating in the direction indicated by the arrow shown in FIG. 1, the intermediate transfer belt 8 sequentially passes through the respective primary-transfer nips. Then, the single-color toner images are transferred from the respective photoconductor drums 1 primarily and superimposed one on another on the intermediate transfer belt 8, forming a multicolor image.

Then, the intermediate transfer belt 8 carrying the multicolor toner image reaches a position facing a secondary-transfer roller 19 disposed facing the secondary-transfer backup roller 12. The secondary-transfer backup roller 12 and the secondary-transfer roller 19 press against each other via the intermediate transfer belt 8, and the contact portion therebetween is hereinafter referred to as a secondary-transfer nip. The multicolor toner image formed on the intermediate transfer belt 8 is transferred onto a sheet P (recording medium) transported to the secondary-transfer nip (secondary-transfer process). A certain amount of toner tends to remain on the intermediate transfer belt 8 after the secondary-transfer process.

When the intermediate transfer belt 8 reaches a position facing the intermediate-transfer cleaning unit 10, toner remaining on the intermediate transfer belt 8 is collected by the intermediate-transfer cleaning unit 10. Thus, a sequence of image forming processes performed on the intermediate transfer belt 8 is completed.

The sheet P is transported by a sheet feeder 26 provided in the lower portion of the apparatus body to the secondary-transfer nip via a sheet feeding roller 27, pairs of conveyance rollers, and a pair of registration rollers 28. More specifically, the sheet feeder 26 contains multiple sheets P piled one on another. The sheet feeding roller 27 rotates counterclockwise in FIG. 1 to feed the sheet P on the top toward a nip between the registration rollers 28.

When a leading edge of the sheet P reaches the nip therebetween, the registration rollers 28 suspend rotation, stopping the sheet P. The registration rollers 28 resume rotating to transport the sheet P to the secondary-transfer nip, timed to coincide with the arrival of the multicolor toner image formed on the intermediate transfer belt 8. In the secondary-transfer nip, the multicolor toner image is transferred from the intermediate transfer belt 8 onto the sheet P (secondary-transfer process).

Subsequently, the sheet P onto which the multicolor image is transferred is transported to a fixing device 20. In the fixing device 20, the multicolor toner image is fixed on the sheet P with heat from a fixing roller and pressure exerted by a pressure roller. Then, the sheet P is discharged through a nip between discharge rollers 29 outside the apparatus and stacked on a stack tray 30 as an output image.

Thus, a sequence of image forming processes is completed.

Next, a configuration and operation of the developing device 5Y in the image forming unit 6Y is described in further detail below. In the descriptions below, the subscript "Y" attached to the components of the developing device 5Y may be omitted. The developing device 5Y includes a developing roller 51Y, a doctor blade 52Y, a developer chamber 50 including first and second developer compartments 53Y and 54Y, first and second conveying screws 55Y and 56Y, and a density sensor 57Y. The developing device 5Y according to the present embodiment is a biaxial circulation-type developing device and also called a horizontal biaxial circulation-type developing device since the two axes are arranged horizontally.

The developing roller 51Y faces the photoconductor drum 1Y, and the doctor blade 52Y faces the developing roller 51Y. The first and second conveying screws 55Y and 56Y are respectively disposed in the first and second developer compartments 53Y and 54Y partitioned by the partition 60. The density sensor 57Y detects the density of toner in the second developer compartment 54Y provided with the second conveying screw 56Y.

The developing roller 51Y includes a stationary magnet or stationary multiple magnets and a sleeve that rotates around the stationary magnet. Two-component developer consisting essentially of carrier (carrier particles) and toner (toner particles) is contained in the first and second developer compartments 53Y and 54Y. In the drawings, reference character "G" is given to developer although the reference character "G" is omitted in the description below. The second developer compartment 54Y communicates with a toner conveying pipe 64Y, which defines a powder conveyance channel, through a toner supply inlet 65Y (i.e., toner supply inlet 65Y) provided in an upper portion of the second developer compartment 54Y.

Operation of the developing device 5Y is described below.

The sleeve of the developing roller 51Y rotates in the direction indicated by arrow Y2 shown in FIG. 2. The developer held on the developing roller 51Y by the magnetic field generated by the magnets moves on the developing roller 51Y as the sleeve rotates.

The ratio of toner to carrier (the concentration of toner) in developer contained in the developing device 5Y is adjusted within a predetermined range. More specifically, according to the consumption of toner in the developing device 5Y, the toner supply device 31 supplies toner from the toner cartridge 32Y via a toner supply channel and the toner conveying pipe 64Y to the second developer compartment 54Y from the toner supply inlet 65Y.

Then, while the supplied toner is mixed with carrier and stirred by the second conveying screw 56Y and further by the first conveying screw 55Y and the mixture thereof is circulated as developer in the first and second developer compartments 53Y and 54Y. The circulation is perpendicular to the surface of the paper on which FIG. 2 is drawn. Then, toner is electrically charged through friction with carrier, adsorbed to the carrier, and carried on the developing roller 51Y together with the carrier.

The developer carried on the developing roller 51Y is transported in the direction indicated by arrow Y2 in FIG. 2 to the doctor blade 52Y. The amount of developer on the developing roller 51Y is adjusted to a suitable amount by the doctor blade 52Y, after which the developer is transported to the development range facing the photoconductor drum 1Y. Then, the toner in developer adsorbs to the latent image formed on the photoconductor drum 1Y due to the effect of the magnetic field generated in the development range. Subsequently, as the sleeve rotates, the developer remaining on the developing roller 51Y reaches an upper portion of the first developer compartment 53Y and leaves the developing roller 51Y.

Figure 3A:
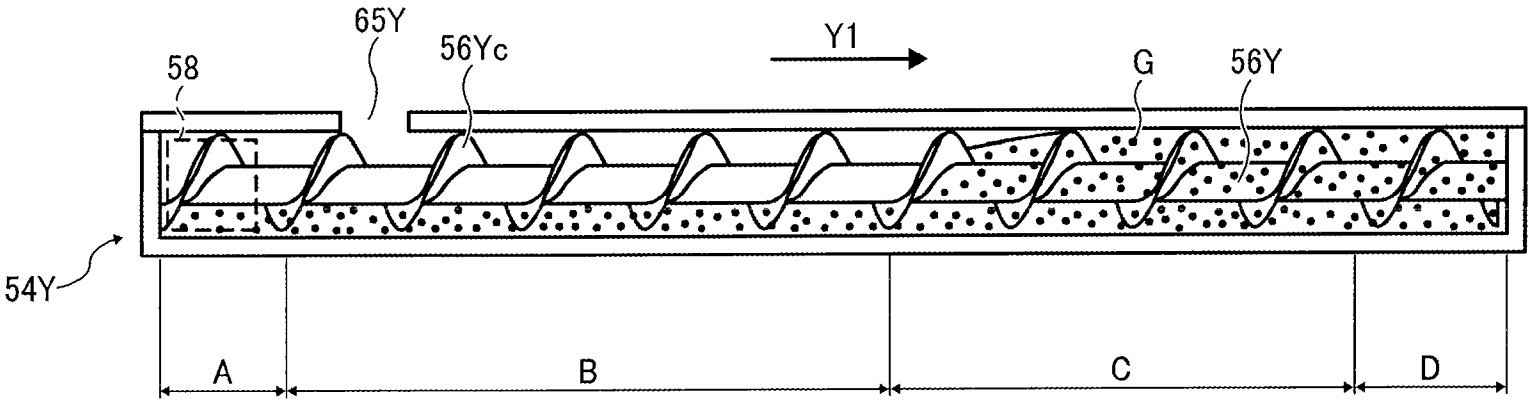
FIGS. 3A through 3E illustrate an interior of a second developer compartment according to an embodiment.
Figure 3B:
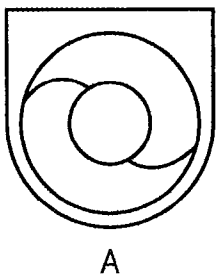
Figure 3C:
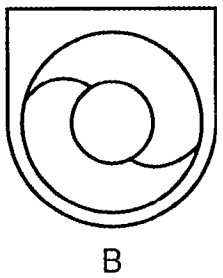

FIG. 3A is a vertical cross-sectional view that illustrates an interior of the second developer compartment 54Y along the axis of the second conveying screw 56Y. FIGS. 3B through 3E are cross-sectional views perpendicular to the cross section shown in FIG. 3A and illustrate cross sections in ranges A through D shown in FIG. 3A, respectively. In FIG. 3A, reference numeral 56Yc represents a screw blade of the second conveying screw 56Y.

In FIG. 3A, arrow Y1 indicates the direction in which developer is transported (hereinafter "developer conveyance direction) in the second developer compartment 54Y. In the range A corresponding to FIG. 3B, an opening 58, serving as a first communicating portion (i.e., a developer returning opening) is provided for developer to return from the first developer compartment 53Y to the second developer compartment 54Y. The first developer compartment 53Y is for stirring and supplying developer to the developing roller 51Y and thus serves as a supply-side developer compartment. The second developer compartment 54Y is for stirring and transporting developer to the first developer compartment 53Y and thus serves as a replenishment-side developer compartment.

The toner supply inlet 65Y is positioned midway in the range B, and toner supplied from the toner cartridge 32Y via the toner conveying pipe 64Y enters the range B through the toner supply inlet 65Y. Accordingly, it is preferred to disperse toner in developer uniformly in the range B.

Figure 3D:
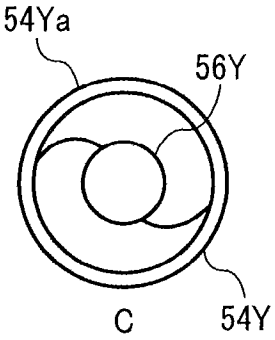
Figure 3E:
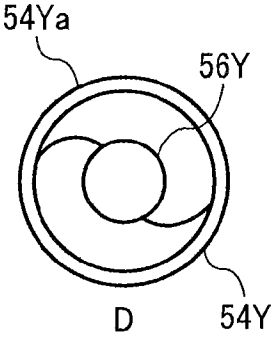

In the range C, a ceiling portion 54Ya of a wall defining the second developer compartment 54Y is circular conforming to the outer circumference of the second conveying screw 56Y as shown in FIG. 3D.

The ceiling portion 54Ya in the range D is similar to that in the range C. Further, a communicating portion 59 (shown in FIG. 4B) is provided in the partition 60 in the range D to send developer from the second developer compartment 54Y to the first developer compartment 53Y. In the ranges C and D, a clearance of about 1.5 mm is secured between the screw blade 56Yc of the second conveying screw 56Y and the wall face of the second developer compartment 54Y. The ranges C and D together occupy about 40% in the longitudinal length of the second developer compartment 54Y.

Figure 4A:
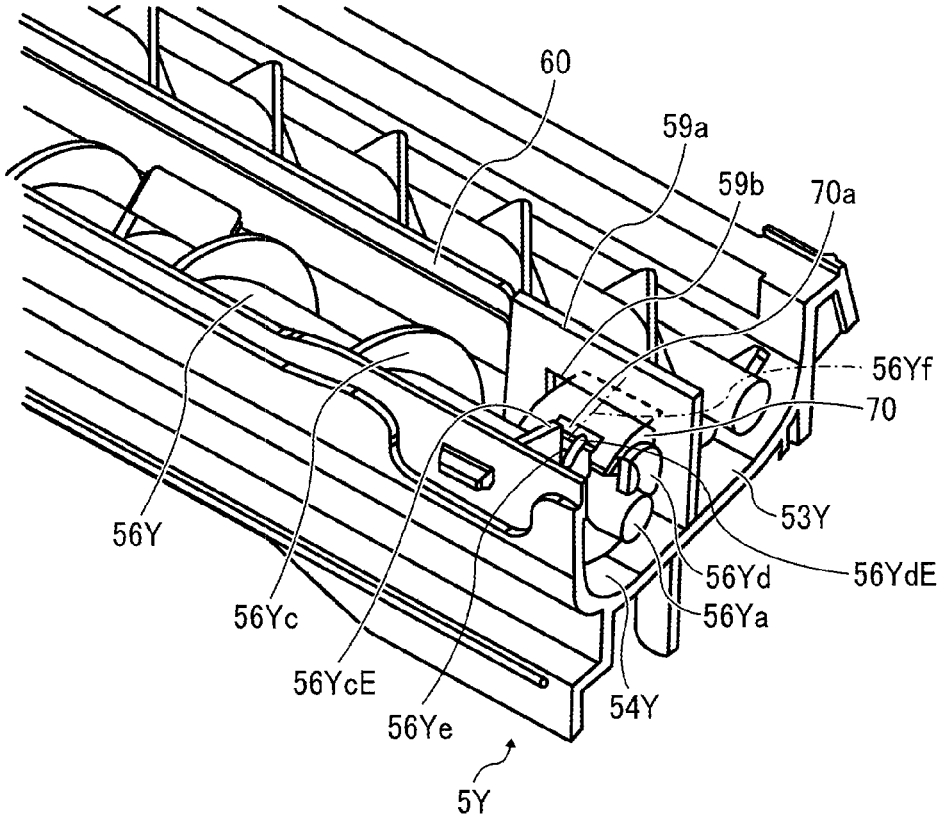
FIG. 4A is a perspective view illustrating relations among a first developer compartment, the second developer compartment, and a communicating portion therebetween according to an embodiment.
Figure 4B:
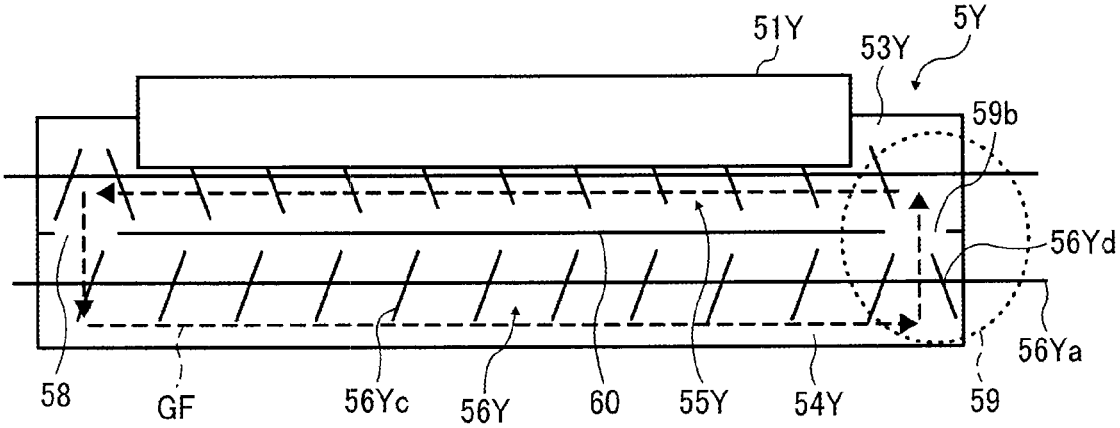
FIG. 4B illustrates the developing device shown in FIG. 2 as viewed from above.

FIG. 4A is a perspective view of a main part of the developing device 5Y, without an upper case (i.e., a lid) thereof, for understanding of relations among the first and second developer compartments 53Y and 54Y and the communicating portion 59. FIG. 4B is a view from above of the developing device 5Y shown in FIG. 2 for understanding of flow of developer therein.

Although the upper portions of the first and second developer compartments 53Y and 54Y do not conform to the screw shape in FIG. 4A, the first and second developer compartments 53Y and 54Y have the cross-sectional shapes shown in FIGS. 3B through 3E when the upper case is attached to the developing device 5Y. With this configuration, developer can be inhibited from flowing from the second developer compartment 54Y to the first developer compartment 53Y in areas other than the communicating portion 59.

In the present embodiment, the range A and the range D are positioned on the distal side and the proximal side of the apparatus, respectively. The toner supplied from the toner supply inlet 65 to the developer in the second developer compartment 54Y is transported from the range A to the range D by the second conveying screw 56Y while being stirred with developer. Then, the developer is received in the first developer compartment 53Y through an opening 59*b* provided in the range D on the proximal side of the apparatus and returned to the opening 58 (the developer returning opening) by the first conveying screw 55Y and further to the second developer compartment 54Y. Then, the developer is again transported to the opening 59*b* by the second conveying screw 56Y while being stirred. This action is repeated. The flow of developer at that time is indicated by arrow GF in FIG. 4B. It is to be noted that that the distal side and the proximal side of the apparatus are based on the front view of the image forming apparatus 100 shown in FIG. 1.

Reducing the opening area of the opening 59*b* of the communicating portion 59 is advantageous in dissolving flocculation of developer since developer is compacted in front of the opening 59*b*. However, when the opening area is extremely small, the bulk of developer in the first developer compartment 53Y decreases, thus inviting defective scooping of developer (e.g., insufficiency in the amount of developer scooped up) or the like. That is, it is preferred to keep a proper bulk of developer in the communicating portion 59. For that, the amount of developer passing through the communicating portion 59 is kept at a proper amount constantly.

The amount of developer passing through the communicating portion 59 depends on various variables such as the flowability of developer, toner density, the rotational frequency of the screw, the opening area, the position of the opening, the screw pitch, the amount of developer contained in the developing device 5, and the like. It is relatively easy to keep a proper amount of developer transported and a proper compacted state of developer using a single developer-related variable. The bulk and the flowability of developer, however, fluctuate depending on variables such as density of toner, degradation of toner with time, temperature, humidity, the area of images output, and the like. Accordingly, it is preferred to achieve settings to break flocculation of developer without causing inconveniences in a conceivable usage range in any of the variables.

For example, the settings to achieve a desirable loosening capability without causing defective scooping of developer can be found while the opening area of the communicating portion 59 and the rotational frequency of the second conveying screw 56Y in the second developer compartment 54Y are adjusted using an initial developer having a toner concentration of 7%. However, when the toner concentration is changed to a range from 4% to 10% in such settings, the bulk of developer in the first and second developer compartments 53Y and 54Y can fluctuate sharply, and flocculation is not broken when the toner concentration is lower. Additionally, when the toner concentration is higher, the torque of the unit rises to an unacceptable value, and the bulk of developer in the first developer compartment 53Y decreases.

As a result of a research, the inventors have found that providing, to the communicating portion 59, a flexible sheet such that the flexible sheet projects from the opening 59*b* is advantageous in coping with changes in properties of developer. With this configuration, even when the flowability of developer changes due to changes in the toner concentration or changes inherent to elapse of time, the amount of developer transported through the communicating portion 59 can be kept within a desirable range while maintaining the capability to loosen flocculation of developer.

Figure 5A:
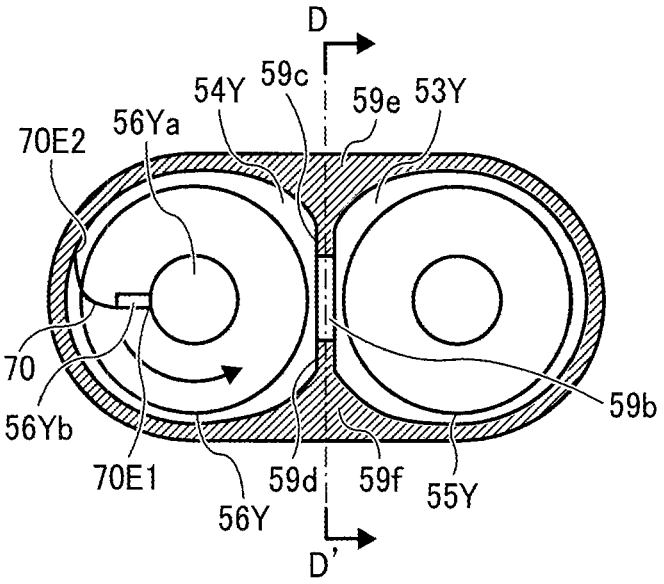
FIGS. 5A and 5B are cross-sectional views illustrating configurations of the communicating portion shown in FIG. 4A.
Figure 5B:
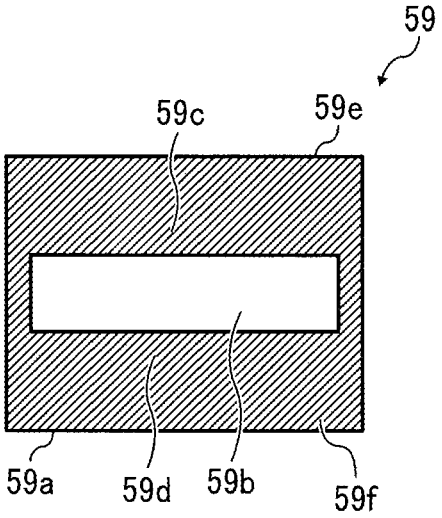

Descriptions are given below of location of a flexible sheet 70, which can be a plastic sheet such as Mylar® (registered trademark of DuPont), with reference to FIGS. 4A, 4B, 5A, and 5B. FIG. 5A is a cross-sectional view of the communicating portion 59 along a face perpendicular to a screw shaft 56Ya of the second conveying screw 56Y. FIG. 5B is a cross-sectional view of the communicating portion 59 along line D-D' shown in FIG. 5A, which is at a half of a thickness of the partition 60.

As shown in FIG. 4A, in the present embodiment, the flexible sheet 70 is provided to the second conveying screw 56Y facing the opening 59*b* of the communicating portion 59. A length and a width of the flexible sheet 70 are designed such that a free end 70E2 (shown in FIG. 5A) of the flexible sheet 70 projects through the opening 59*b* into the interior of the first developer compartment 53Y when the flexible sheet 70 is positioned to face the opening 59*b*. Specifically, in a radial direction of the second conveying screw 56Y, the flexible sheet 70 is longer than a distance from a base end 70E1 (shown in FIG. 5A) of the flexible sheet to either the upper wall face 59*c* or the lower wall face 59*d* (i.e., inner wall face of the second developer compartment).

A base 56Yb (shown in FIG. 5A) to which a base end portion of the flexible sheet 70 is attached stands vertically on the screw shaft 56Ya of the second conveying screw 56Y in the second developer compartment 54Y. The flexible sheet 70 having a thickness of, for example, about 0.18 mm is attached to the base 56Yb. As shown in FIG. 4A, the second conveying screw 56Y includes a first spiral blade winding in a normal direction (hereinafter "normal spiral 56Yc") and a second spiral blade winding in a direction reserve thereto (hereinafter "reverse spiral 56Yd"). It is to be noted that the normal spiral 56Yc and the reverse spiral 56Yd are separate from each other in the present embodiment. Alternatively, the normal spiral 56Yc may be continuous with the reverse spiral 56Yd.

A center (indicated by line 56Yf in FIG. 4A) of the flexible sheet 70 in the longitudinal direction of the flexible sheet 70 (parallel to the rotation axis of the second conveying screw 56Y) is aligned with an intermediate point 56Ye between an end 56YcE of the normal spiral 56Yc and an end 56YdE of the reverse spiral 56Yd adjacent to each other. An opening 70*a* is provided in to the base end portion of the flexible sheet 70 attached to the base 56Yb so that developer passes through the opening 70*a*. The opening 70*a* reduces pressure of developer applied to the flexible sheet 70 when the second conveying screw 56Y rotates. An opening area of the opening 70*a* is adjusted according to the pressure of developer applied to the flexible sheet 70.

In the present embodiment, in the range D, the second conveying screw 56Y includes the two spiral blades, namely, the normal spiral 56Yc, to transports developer from the toner supply inlet 65Y to the opening 59*b*, and the reverse spiral 56Yd, to transport developer from extreme downstream in the developer conveyance direction in the second developer compartment 54Y to the opening 59*b*. The intermediate point 56Ye is positioned to face the opening 59*b*. Developer is compacted and then forwarded from the second developer compartment 54Y to the first developer compartment 53Y.

In the communicating portion 59, instead of the partition 60, a partition 59*a* including the opening 59*b* is provided between the first and second developer compartments 53Y and 54Y so that developer is sent from the second developer compartment 54Y to the first developer compartment 53Y. In the present embodiment, for example, the opening 59*b* is rectangular and has a height of about 4 mm and a long side length of about 14 mm.

It is to be noted that the partition 60 and the partition 59*a* can be either continuous or separate.

As shown in FIG. SA, the opening 59*b* of the communicating portion 59 is interposed between an upper wall face 59*c* and a lower wall face 59*d* of the partition 59*a*. Thus, a portion through which developer is sent to the first developer compartment 53Y is reduced by the upper wall face 59*c* and the lower wall face 59*d*.

It is to be noted that the upper wall face 59*c* extends vertically down from a ceiling 59*e* (i.e., an upper wall) of the communicating portion 59, and the lower wall face 59*d* extends vertically up from a bottom wall 59*f* of the communicating portion 59.

FIGS. 6A through 6D illustrates behavior of the flexible sheet 70 when the second conveying screw 56Y rotates.

Figure 6A:
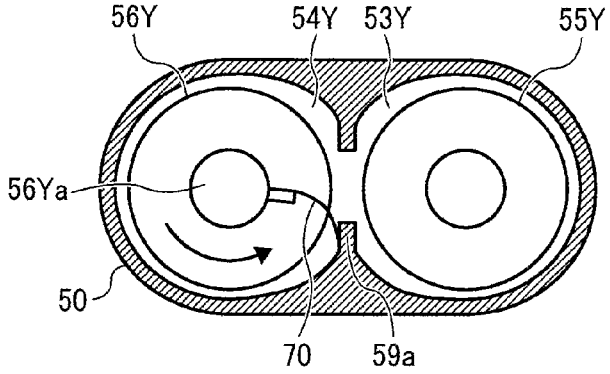
FIGS. 6A through 6D are cross-sectional views for understanding of behavior of a flexible sheet according to an embodiment.

Referring to FIG. 6A, as the second conveying screw 56Y rotates, the free end 70E2 of the flexible sheet 70 contacts the partition 59*a* (the lower wall face 59*d* shown in FIG. 5A). Then, while elastically deforming further, the flexible sheet 70 is pushed up.

Figure 6B:
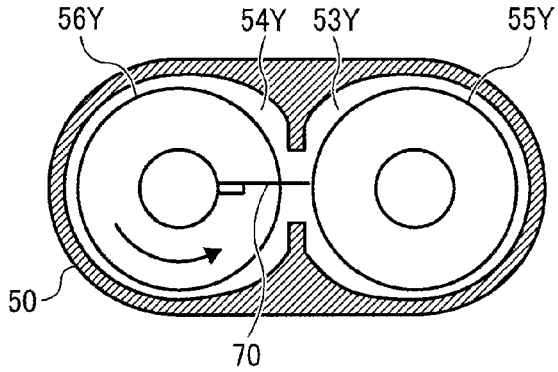

Referring to FIG. 6B, the free end 70E2 of the flexible sheet 70 passes through the opening 59*b* and projects into the first developer compartment 53Y. Then, elastic deformation of the flexible sheet 70 stops.

Figure 6C:
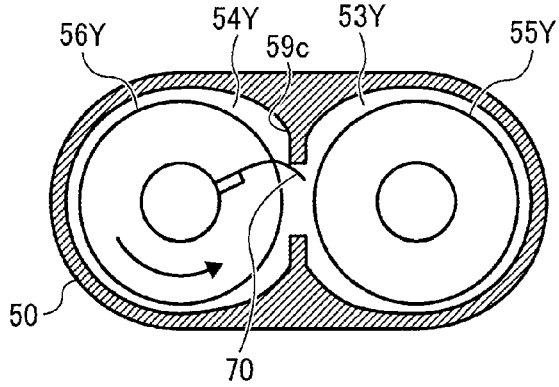

Referring to FIG. 6C, the free end 70E2 of the flexible sheet 70 contacts a lower end of the upper wall face 59*c* defining an upper end of the opening 59*b*, and the flexible sheet 70 starts elastic deformation.

Figure 6D:
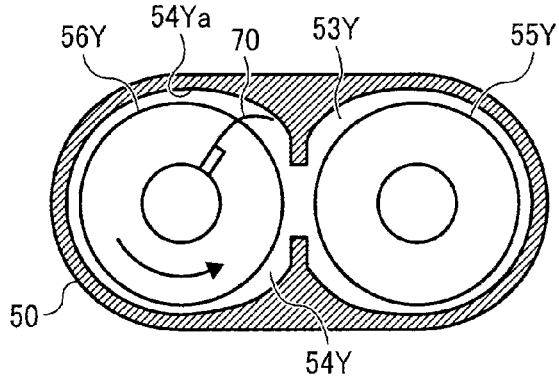

Referring to FIG. 6D, the free end 70E2 of the flexible sheet 70 overstrides the lower end of the upper wall face 59*c*, returns to the second developer compartment 54Y, and rotates while being contact with an inner face including the ceiling portion 54Ya of the second developer compartment 54Y.

Thus, the free end 70E2 of the flexible sheet 70 projects into and withdraws from the first developer compartment 53Y each time the second conveying screw 56Y makes a complete turn. In other words, the free end 70E2 of the flexible sheet 70 cyclically moves back and forth between the first developer compartment 53Y and the second developer compartment 54Y.

As the amount by which the flexible sheet 70 projects (hereinafter "projecting amount") increases, the amount of developer transported at that time increases. For example, the projecting amount of the flexible sheet 70 is increased in a case where the amount of developer in the second developer compartment 54Y becomes excessive and the degree of compaction is extremely high, or a case where the amount of developer in the first developer compartment 53Y becomes extremely small. In other words, the flexible sheet 70 is increased in length. On the contrary, the projecting amount of the flexible sheet 70 is reduced in a case where the amount of developer in the second developer compartment 54Y becomes extremely small and the degree of compaction is extremely low, or a case where the amount of developer in the first developer compartment 53Y becomes excessive. In other words, the flexible sheet 70 is reduced in length. Thus, the amount of developer sent through the opening 59*b* of the communicating portion 59 is adjustable.

It is to be noted that, in the present embodiment, the screw pitch of the second conveying screw 56Y in the second developer compartment 54Y is about 40 mm in the normal spiral 56Yc on the upstream side in the developer conveyance direction and about 20 mm in the normal spiral 56Yc on the downstream side in the developer conveyance direction. The configuration of the second conveying screw 56Y is not limited to the above-described configuration as long as developer amount is balanced such that developer is compacted upstream from the communicating portion 59.

With this configuration, as shown in FIG. 3A, the bulk (i.e., level) of developer in the second developer compartment 54Y is lower at the toner supply position (toner supply inlet 65Y) on the upstream side, and, in a downstream area, developer is packed to the ceiling portion 54Ya conforming to the screw shape. In particular, developer is compacted extreme downstream in the second developer compartment 54Y. If the ceiling portion 54Ya of the second developer compartment 54Y does not conform to the spiral shape and clearance where developer is absent is larger as in the range B shown in FIG. 3C, rotation of the spiral blade is not transmitted to an area outside the spiral blade in the cross section perpendicular to the axial direction, and thus an immobile layer of developer is created. By contrast, since the second developer compartment 54Y has a circular cross section following the spiral shape, such an immobile layer is not created and developer can be transported smoothly.

In the present embodiment, flocculating developer (i.e., flocculation) is broken using rotation of the flexible sheet 70 when the developer passes through the opening 59*b* of the communicating portion 59. Effects of the present embodiment on loosening flocculating developer were examined as follows. In the examination, an amount of flocculating developer greater than the amount created in a real apparatus was put in the toner supply inlet 65Y. The flocculating developer was created as follows.

i) In a Hitachi centrifugal machine Himac CP100MX, 0.5 g per cell of polymerized toner having a particle diameter of 5.2 μm was put. The toner was subjected to centrifugal pressure under the conditions of a frequency of centrifugal rotation of 12000 revolutions per minute (rpm), a centrifugal time of 5 minutes, and a temperature of 23° C.

ii) Subsequently, toner in the cell was sieved using a sieve having a mesh opening of 106 μm. Flocculating developer remaining in the sieve was put in the toner supply inlet 65 of the developing device 5.

It is to be noted that the inventors of the present invention have found the above-described conditions seeking conditions under which the level of image failure, namely, spots, white lines, and shooting star marks, is similar to the level of image failure caused by flocculating developer arising in the toner bottle (toner cartridge 32) or the toner supply device 31.

The flocculation thus created was put in the toner supply inlet 65Y of the developing device 5Y, solid images were output on 20 sheets of A3 paper, and the number of spots and shooting star marks were evaluated.

According to the evaluation, compared to a comparative developing device, image failure such as spots, shooting star marks, and the like resulting from flocculation are reduced significantly. Tolerances against fluctuations in bulk of developer and in flowability were evaluated while changing developer-related variables such as the toner density (an upper limit and a lower limit) and degree of degradation of developer (initial developer and developer degraded with time). In any of these conditions, spots and shooting star marks resulting from flocculation are reduced.

It is to be noted that, in the comparative developing device, developer does not contact the ceiling portion 54Ya of the second developer compartment 54Y, compaction is not attained, and the flexible sheet 70 is not provided to the communicating portion 59.

As described above, the following effects can be attained by the present embodiment.

Aspect 1) Aspect 1 concerns a developing device that includes the first developer compartment 53Y to supply developer to the developing roller 51Y (developer bearer), the second developer compartment 54Y to supply developer to the first developer compartment 53Y, the communicating portion 59 through which developer is transferred from the second developer compartment 54Y to the first developer compartment 53Y, and the second conveying screw 56Y to transport developer inside the second developer compartment 54Y to the communicating portion 59. The developing device further includes the flexible sheet 70 provided to the second conveying screw 56Y and positioned facing the communicating portion 59. The flexible sheet 70 rotates integrally with the second conveying screw 56Y. As the second conveying screw 56Y rotates, the flexible sheet 70 cyclically projects into and withdraws from the first developer compartment 53Y through the opening 59*b*.

Accordingly, even when the properties of developer change, the amount of developer transferred through the communicating portion 59 can be kept in a proper range. That is, an action of the flexible sheet 70 makes it possible to transfer developer while loosening flocculation of developer, and the amount of developer transferred through the communicating portion 59 can be kept in a proper range corresponding to changes in the properties of developer. This aspect can attain conditions under which shearing force to break flocculation of developer is exerted while inhibiting excessive force, even when the properties of developer change. Accordingly, desirable images without spots and shooting star marks are produced for a long time.

Aspect 2) Each time the second conveying screw 56Y makes a complete turn, the free end 70E2 of the flexible sheet 70 reciprocates between the first developer compartment 53Y and the second developer compartment 54Y. Accordingly, the flocculation can be broken at the opening 59*b*.

Aspect 3) The second conveying screw 56Y includes the rotation shaft 56Ya and first and second spiral blades (the normal spiral 56Yc and the reverse spiral 56Yd) provided to the outer circumference of the rotation shaft 56Ya and winding in the opposite directions. A center of the flexible sheet 70 in a direction parallel to the rotation axis of the second conveying screw 56Y, a center of the opening 59*b* in direction parallel to the rotation axis of the second conveying screw 56Y, and a center of an adjacent portion between the first and second spiral blades in that direction are aligned with each other in the direction (line 56Yf in FIG. 4A) perpendicular to the longitudinal direction of the rotation axis. Accordingly, the flocculation of developer transferred from the opening 59*b* into the first developer compartment 53Y can be loosened evenly.

Aspect 4) The flexible sheet 70 elastically deforms when the free end 70E2 of the flexible sheet 70 rotates following an inner face of the second developer compartment 54Y. When the free end 70E2 of the flexible sheet 70 reaches the opening 59*b*, the elastic deformation is canceled, and the projects into the first developer compartment 53Y. With this action, developer in which flocculation is broken can be transferred to the first developer compartment 53Y.

Aspect 5) Since a process cartridge includes the developing device 5Y according to the above-described embodiment, the process cartridge can attain the effects described in aspects 1 through 4.

Aspect 6) Since the image forming apparatus 100 includes either the developing device 5Y according to the above-described embodiment or the process cartridge according to aspect 5, the image forming apparatus can attain the effects described in aspects 1 through 4.

Numerous additional modifications and variations are possible in light of the above teachings. It is therefore to be understood that, within the scope of the appended claims, the disclosure of this patent specification may be practiced otherwise than as specifically described herein.

What is claimed is:

1. A developing device comprising:

a developer bearer;

a first developer compartment to supply developer to the developer bearer;

a second developer compartment to supply developer to the first developer compartment, the second developer compartment adjacent to the first developer compartment;

a partition to divide, at least partly, the first developer compartment from the second developer compartment, the partition including a communicating opening through which developer is transferred from the second developer compartment to the first developer compartment;

a rotary conveyor to transport developer inside the second developer compartment to the communicating opening; and a flexible sheet provided to the rotary conveyor and positioned facing the communicating opening, the flexible sheet to rotate integrally with the rotary conveyor and project through the communicating opening into the first developer compartment as the rotary conveyor rotates.

2. The developing device according to claim 1, wherein, in a radial direction of the rotary conveyor, the flexible sheet is longer than a distance from a base end of the flexible sheet to an inner wall face of the second developer compartment, and each time the rotary conveyor makes a complete turn, an end of the flexible sheet opposite the base end reciprocates between the first developer compartment and the second developer compartment.

3. The developing device according to claim 1, wherein the rotary conveyor comprises:

a rotation shaft;

a first spiral blade provided to an outer circumference of the rotation shaft; and a second spiral blade provided to the outer circumference of the rotation shaft and winding in a direction reverse to a direction in which the first spiral blade winds, and a center of the flexible sheet in an axial direction of the rotary conveyor, a center of the communicating opening in the axial direction of the rotary conveyor, and an intermediate point between an end of the first spiral blade and an end of the second spiral blade adjacent to each other in the axial direction of the rotary conveyor are aligned with each other in a direction perpendicular to the axial direction of the rotary conveyor.

4. The developing device according to claim 1, wherein the flexible sheet elastically deforms when an end of the flexible sheet rotates following an inner face of the second developer compartment, and when the end of the flexible sheet reaches the communicating opening, the flexible sheet reverts from an elastic deformation and projects into the first developer compartment.

5. A process cartridge comprising:

an image bearer to bear a latent image; and the developing device according to claim 1 to develop the latent image into a visible image.

6. An image forming apparatus comprising:

an image bearer to bear a latent image; and the developing device according to claim 1 to develop the latent image into a visible image.

7. The image forming apparatus according to claim 6, further comprising a process cartridge removably installable in the image forming apparatus, the process cartridge including the image bearer and the developing device.

8. A method of transferring developer in a developing device including a first developer compartment, a second developer compartment, and a rotary conveyor to transport developer in the second developer compartment, the method comprising:

integrally rotating the rotary conveyor and a flexible sheet disposed on the rotary conveyor and positioned to face a communicating opening through which developer is transferred to the first developer compartment from the second developer compartment; and transferring developer from the second developer compartment to the first developer compartment while the flexible sheet cyclically projects into and withdraws from the first developer compartment as the rotary conveyor rotates.

9. A developing device comprising:

a developer bearer;

a first developer compartment to supply developer to the developer bearer;

a second developer compartment to supply developer to the first developer compartment, the second developer compartment adjacent to the first developer compartment;

a partition to divide, at least partly, the first developer compartment from the second developer compartment, the partition including a communicating opening through which developer is transferred from the second developer compartment to the first developer compartment;

a means for transporting developer inside the second developer compartment to the communicating opening by rotation; and a means for loosening developer, the means for loosening to project through the communicating opening into the first developer compartment while rotating.

10. The developing device according to claim 9, wherein, each time the means for transporting makes a complete turn, an end of the means for loosening reciprocates between the first developer compartment and the second developer compartment.

11. The developing device according to claim 9, wherein the means for transporting comprises:

a rotation shaft;

a first spiral blade provided to an outer circumference of the rotation shaft; and a second spiral blade provided to the outer circumference of the rotation shaft and winding in a direction reverse to a direction in which the first spiral blade winds, and a center of the means for loosening in an axial direction of the rotation shaft, a center of the communicating opening in the axial direction of the rotation shaft, and an intermediate point between an end of the first spiral blade and an end of the second spiral blade adjacent to each other in the axial direction of the rotation shaft are aligned with each other in a direction perpendicular to the axial direction of the rotation shaft.

12. The developing device according to claim 9, wherein the means for loosening elastically deforms when an end of the means for loosening rotates following an inner face of the second developer compartment, and when the end of the means for loosening reaches the communicating opening, the means for loosening reverts from an elastic deformation and projects into the first developer compartment.

13. A process cartridge comprising:

an image bearer to bear a latent image; and the developing device according to claim 9 to develop the latent image into a visible image.

14. An image forming apparatus comprising:

an image bearer to bear a latent image; and the developing device according to claim 9 to develop the latent image into a visible image.

15. The image forming apparatus according to claim 14, further comprising a process cartridge removably installable in the image forming apparatus, the process cartridge including the image bearer and the developing device.

* * * * *